US006116060A

United States Patent [19]

Strader

[11] Patent Number: 6,116,060

[45] Date of Patent: Sep. 12, 2000

[54] WASHING AND DRYING LAUNDRY SYSTEM

[76] Inventor: Jimmy D. Strader, 905 Klenck Ct., Henderson, Ky. 42420

[21] Appl. No.: 09/199,251

[22] Filed: Nov. 25, 1998

[51] Int. Cl.[7] ..... D06F 25/00

[52] U.S. Cl. ..... 68/20; 34/596; 34/599; 34/607; 68/19.2; 68/146; 68/171

[58] Field of Search ..... 68/19.2, 20, 23 R, 68/24, 146, 171, 173, 174; 34/596, 599, 602, 603, 607, 139

[56] References Cited

U.S. PATENT DOCUMENTS

| | | | |
|---|---|---|---|
| 2,231,189 | 2/1941 | Kirby | 68/23 R |
| 2,555,400 | 6/1951 | De Remer | 68/23 R |
| 2,574,798 | 11/1951 | Rasmussen | 68/19.2 X |
| 2,895,320 | 7/1959 | Long | 68/19.2 X |
| 2,986,914 | 6/1961 | Brucken | 68/19.2 X |
| 5,074,131 | 12/1991 | Hirose et al. | 68/20 X |
| 5,588,313 | 12/1996 | Hildebrand | 68/20 X |

FOREIGN PATENT DOCUMENTS

| | | | |
|---|---|---|---|
| 174897 | 7/1990 | Japan | 68/20 |

*Primary Examiner*—Philip R. Coe

[57] ABSTRACT

A washer and dryer combination is provided including a housing having a fixed casing and a rotating basin rotatably mounted within the fixed casing. Also included is a rotation motor for rotating the rotating basin upon the actuation thereof, a hot air generation assembly for delivering hot air in the rotating basin upon the actuation thereof, an exhaust mechanism for expelling air from the rotating basin, a water delivery assembly for allowing the flow of water into the rotating basin upon the actuation thereof, and a water expelling mechanism including a pump for pumping water from the rotating basin upon the actuation thereof. Next provided is a control panel including a keypad and a display for selectively actuating the rotation motor, the hot air generation assembly, the water delivery assembly, and the pump of the water expelling mechanism.

5 Claims, 3 Drawing Sheets

WASHING AND DRYING LAUNDRY SYSTEM

BACKGROUND OF THE INVENTION

1. Field of the Invention

The present invention relates to washing and drying machines and more particularly pertains to a new washing and drying laundry system for both washing and drying clothes with a single unit.

2. Description of the Prior Art

The use of washing and drying machines is known in the prior art. More specifically, washing and drying machines heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,765,162; U.S. Pat. No. 4,757,699; U.S. Pat. No. 3,006,176; U.S. Pat. No. 4,903,508; U.S. Pat. Des. 360,501; and U.S. Pat. No. 2,571,761.

In these respects, the washing and drying laundry system according to the present invention substantially departs from the conventional concepts and designs of the prior art, and in so doing provides an apparatus primarily developed for the purpose of both washing and drying clothes with a single unit.

SUMMARY OF THE INVENTION

In view of the foregoing disadvantages inherent in the known types of washing and drying machines now present in the prior art, the present invention provides a new washing and drying laundry system construction wherein the same can be utilized for both washing and drying clothes with a single unit.

The general purpose of the present invention, which will be described subsequently in greater detail, is to provide a new washing and drying laundry system apparatus and method which has many of the advantages of the washing and drying machines mentioned heretofore and many novel features that result in a new washing and drying laundry system which is not anticipated, rendered obvious, suggested, or even implied by any of the prior art washing and drying machines, either alone or in any combination thereof.

To attain this, the present invention generally comprises a housing having an angled top face, a bottom face, and a rectangular side wall coupled therebetween to define an interior space. As shown in FIG. 2, the top face of the housing has a normal axis which forms about a 30 degree angle with the vertical. A rectangular recess is formed in the top face while a circular opening is formed in a central extent of the recess. Such opening permits access to the interior space during use. A lid is pivotally connected to the top face for selectively closing the top opening. With continuing reference to FIG. 2, the housing further has an upper inner wall coupled to the side wall below and in parallel with the top face of the housing. The upper inner wall is equipped with an opening coincident with the opening of the top face. An inwardly tapering frusto-conical connector wall is coupled between the top face and the upper inner wall for interconnection of the openings. The housing also has a fixed casing. This fixed casing has an open upper end connected to the upper inner wall and a closed bottom end. A cylindrical peripheral wall is positioned between the open upper end and the closed bottom end and is further positioned about the normal axis. Next provided is a rotating basin with a hemispherical bottom portion, a cylindrical intermediate portion and a frusto-conical top portion. The rotating basin has an opening rotatably mounted to the upper inner wall. The bottom portion and the intermediate portion of the rotating basin have a plurality of apertures formed therein. These apertures serve for allowing fluidic communication with an interior of the fixed casing. The rotating basin further has a plurality of agitator strips each coupled along an inner surface of the rotating basin. The agitator strip extend from a center of the bottom portion of the rotating basin to a central extent of the intermediate portion. Ideally, the agitator strips each have a serpentine configuration. FIG. 2 shows a rotation motor mounted to the bottom face of the housing below the fixed casing. A rotor of the rotation motor extends through the fixed casing and coupled to the rotating basin for rotating the same upon the actuation thereof. Associated therewith is a hot air generation assembly including a blower mounted on the bottom face of the housing. Ideally, the blower is positioned adjacent the peripheral side wall with a vertically oriented delivery tube connected between the blower and an upper extent of the fixed casing. The delivery tube serves for delivering hot air into the fixed casing upon the actuation thereof. As shown in FIGS. 1 & 2, an exhaust mechanism is provided including an exhaust tube connected between a slot formed in the connector wall and a port mounted on the rear face of the housing. Also included is a filter unit including a tapering frusto-conical module mounted on an underside of the lid of the housing. Such module is adapted for being inserted within the opening of the top face of the housing when the lid is closed. The module of the filter unit has a lower face with a matrix of bores formed therein. A periphery of the module is equipped with an opening formed therein for communicating with the slot of the connector wall of the housing when the lid is closed. By this structure, air is allowed to pass through a filter positioned within the module and out the exhaust port. A water delivery assembly includes an inlet conduit connected to the upper extent of the fixed casing opposite the delivery tube of the hot air assembly. The inlet conduit is further connected to the rear face of the housing for connection with a water source. A valve is preferably positioned between the inlet conduit and the water source for allowing the flow of water to the fixed casing upon the actuation thereof. Mounted on the bottom face of the housing is a water expelling mechanism including a pump. This pump is connected to a lower end of the fixed casing and a water outlet port for pumping water from the fixed casing to the water outlet port upon the actuation thereof. Finally, positioned on the top face of the housing is a control panel. The control panel includes a keypad and a display for selectively actuating the rotation motor, the blower of the hot air generation assembly, the valve of the water delivery assembly, and the pump of the water expelling mechanism.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new washing and drying laundry system apparatus and method which has many of the advantages of the washing and drying machines mentioned heretofore and many novel features that result in a new washing and drying laundry system which is not anticipated, rendered obvious, suggested, or even implied by any of the prior art washing and drying machines, either alone or in any combination thereof.

It is another object of the present invention to provide a new washing and drying laundry system which may be easily and efficiently manufactured and marketed.

It is a further object of the present invention to provide a new washing and drying laundry system which is of a durable and reliable construction.

An even further object of the present invention is to provide a new washing and drying laundry system which is susceptible of a low cost of manufacture with regard to both materials and labor, and which accordingly is then susceptible of low prices of sale to the consuming public, thereby making such washing and drying laundry system economically available to the buying public.

Still yet another object of the present invention is to provide a new washing and drying laundry system which provides in the apparatuses and methods of the prior art some of the advantages thereof, while simultaneously overcoming some of the disadvantages normally associated therewith.

Still another object of the present invention is to provide a new washing and drying laundry system for both washing and drying clothes with a single unit.

Even still another object of the present invention is to provide a new washing and drying laundry system that includes a housing having a fixed casing and a rotating basin rotatably mounted within the fixed casing. Also included is a rotation motor for rotating the rotating basin upon the actuation thereof, a hot air generation assembly for delivering hot air in the rotating basin upon the actuation thereof, an exhaust mechanism for expelling air from the rotating basin, a water delivery assembly for allowing the flow of water into the rotating basin upon the actuation thereof, and a water expelling mechanism including a pump for pumping water from the rotating basin upon the actuation thereof. Next provided is a control panel including a keypad and a display for selectively actuating the rotation motor, the hot air generation assembly, the water delivery assembly, and the pump of the water expelling mechanism.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
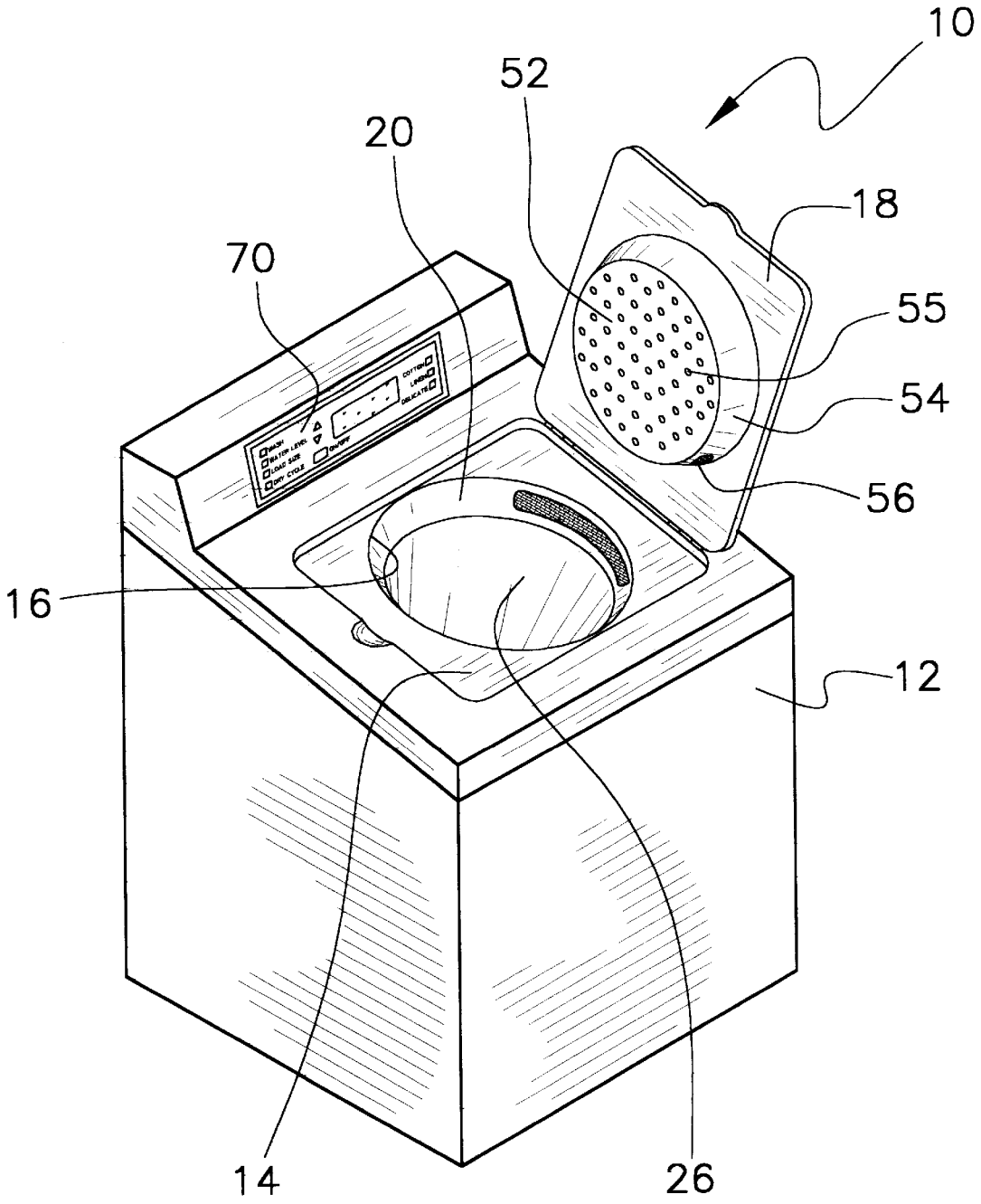
FIG. 1 is a perspective view of a new washing and drying laundry system according to the present invention.

With reference now to the drawings, and in particular to FIGS. 1 through 4 thereof, a new washing and drying laundry system embodying the principles and concepts of the present invention and generally designated by the reference numeral 10 will be described.

Figure 2:
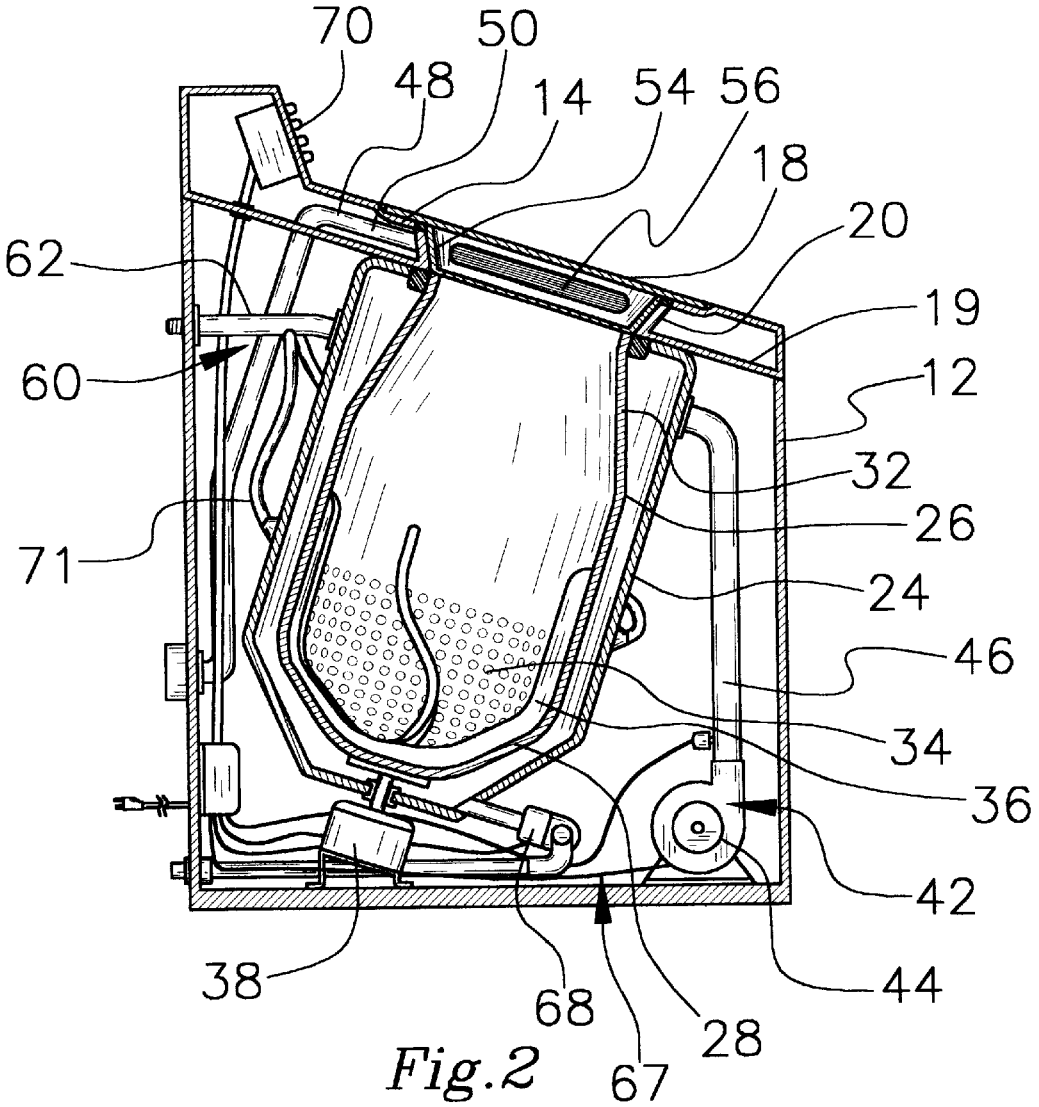
FIG. 2 is a side cross-sectional view of the present invention.
Figure 3:
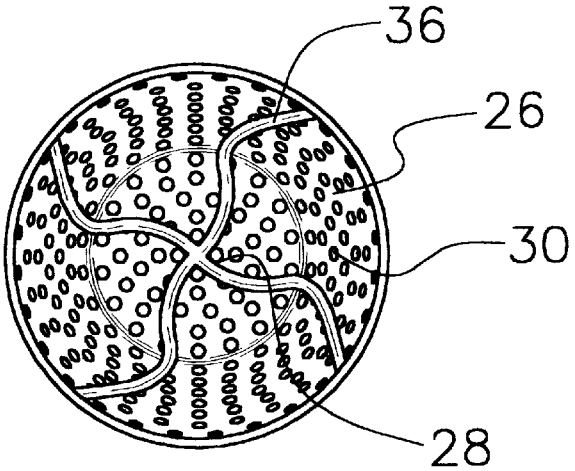
FIG. 3 is a top view of the present invention.
Figure 4:
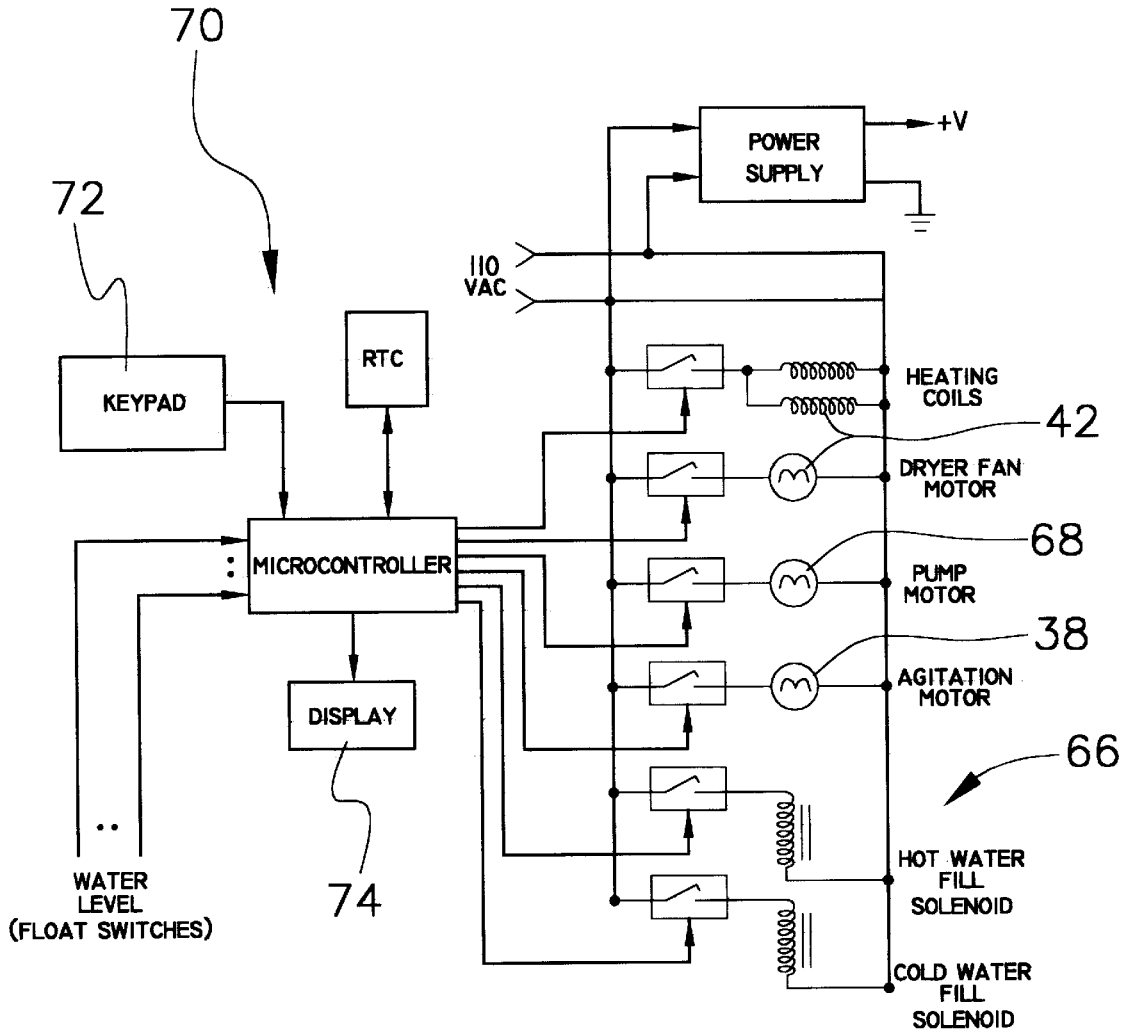
FIG. 4 is a schematic diagram of the present invention.

The present invention, designated as numeral 10, includes a housing 12 having an angled top face, a bottom face, and a rectangular side wall coupled therebetween to define an interior space. As shown in FIG. 2, the top face of the housing has a normal axis which forms about a 30 degree angle with the vertical. A rectangular recess 14 is formed in the top face while a circular opening 16 is formed in a central extent of the recess. Such opening permits access to the interior space during use. A lid 18 is pivotally connected to the top face for selectively closing the circular opening.

With continuing reference to FIG. 2, the housing further has an upper inner wall 19 coupled to the side wall below and in parallel with the top face of the housing. The upper inner wall is equipped with an opening coincident with the opening of the top face. An inwardly tapering frusto-conical connector wall 20 is coupled between the top face and the upper inner wall for interconnection of the openings.

The housing also has a fixed casing 24. This fixed casing has a closed bottom end and an open upper end connected to the upper inner wall. Ideally, the open upper end has an inwardly extending peripheral lip which mounts directly to the upper inner wall about the opening thereof. A cylindrical peripheral wall is positioned between the open upper end and the closed bottom end and is further positioned about the normal axis.

Next provided is a rotating basin 26 with a hemispherical bottom portion 28, a cylindrical intermediate portion 30 and a frusto-conical top portion 32. The rotating basin has an upper peripheral edge rotatably mounted to the upper inner wall via bearings or the like. The bottom portion and the intermediate portion of the rotating basin have a plurality of apertures 34 formed therein. These apertures serve for allowing fluidic communication with an interior of the fixed casing. In the preferred embodiment, apertures cover about ⅓ of the rotating basin.

The rotating basin further has a plurality of agitator strips 36 each coupled along an inner surface of the rotating basin. The agitator strips extend radially from a center of the bottom portion of the rotating basin to a central extent of the intermediate portion. Ideally, the agitator strips each have a serpentine configuration each with at least 2–3 undulations.

FIG. 2 shows a rotation motor 38 mounted to the bottom face of the housing below the fixed casing. A rotor of the rotation motor extends through the fixed casing and coupled to the rotating basin for rotating the same upon the actuation thereof. Associated therewith is a hot air generation assembly 42 including a blower 44 mounted on the bottom face of the housing. Ideally, the blower is positioned adjacent the peripheral side wall with a vertically oriented delivery tube 46 connected between the blower and an upper extent of the fixed casing. The delivery tube serves for delivering hot air in the fixed casing upon the actuation thereof. To accomplish this, the blower assembly is preferably equipped with both a heating element and a fan.

As shown in FIGS. 1 & 2, an exhaust mechanism 48 is provided including an exhaust tube 50 connected between a slot formed in the connector wall and a port mounted on the rear face of the housing. Also included is a filter unit 52 including a tapering frusto-conical module 54 mounted on an underside of the lid of the housing. Such module is adapted for being inserted within the opening of the top face of the housing when the lid is closed.

The module of the filter unit has a lower face with a matrix of bores 55 formed therein. A periphery of the module is equipped with an opening 56 formed therein for communicating with the slot of the connector wall of the housing when the lid is closed. Ideally, both the opening of the module and the slot of the connector wall of the housing are both equipped with a meshed screen. By this structure, air is allowed to pass through a filter positioned within the module and out the exhaust port.

A water delivery assembly 60 includes an inlet conduit 62 connected to the upper extent of the fixed casing opposite the delivery tube of the hot air assembly. The inlet conduit is further connected to the rear face of the housing for connection with a water source. A valve 66 is preferably positioned between the inlet conduit and the water source for allowing the flow of water to the fixed casing upon the actuation thereof. Mounted on the bottom face of the housing is a water expelling mechanism 67 including a pump 68. This pump is connected to a lower end of the fixed casing and a water outlet port for pumping water from the fixed casing to the water outlet port upon the actuation thereof. As shown in FIG. 2, a plurality of water jets 71 may be mounted on the fixed casing in order to spray a stream of water into the fixed casing and through the apertures of the rotating basin.

Finally, positioned on the top face of the housing is a control panel 70. The control panel includes a keypad 72 and a display 74 for selectively actuating the rotation motor, the blower of the hot air generation assembly, the valve of the water delivery assembly, and the pump of the water expelling mechanism.

In use, the rotation motor may be actuated along with the water valve, jets, and pump in order to operate the present invention in a first washing mode. Water sensors may be used to automatically actuate and deactuate the water valve and pump. Further, the rotation motor may be actuated along with the blower so that the present invention may be operated in a second drying mode. Exact times at which the various components are actuated and deactuated are preferably set by the control panel in a manner similar to microwave ovens. In other words, the present invention may be programmed to operate in a first mode from a user-specified start and end time and further operate in a second mode from another user-specified start and end time. This prevents wrinkling and the like in addition to affording convenience. A real time clock is adapted to be depicted on the display to facilitate setting of such times.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A washer and dryer combination comprising, in combination:

a housing including an angled top face, a bottom face, and a rectangular side wall coupled therebetween to define an interior space, the top face having a normal axis which forms about a 30 degree angle with the vertical, a rectangular recess formed in the top face, a circular opening formed in a central extent of the recess for allowing access to the interior space, and a lid pivotally connected to the top face for selectively closing the top opening, the housing further including an upper inner wall coupled to the side wall below and in parallel with the top face of the housing with an opening coincident with the opening of the top face, wherein an inwardly tapering frusto-conical connector wall is coupled between the top face and the upper inner wall for interconnection of the openings, and a fixed casing, the fixed casing having an open upper end connected to the upper inner wall, a closed bottom end and a cylindrical peripheral wall positioned therebetween and being positioned about the normal axis;

a rotating basin with a hemispherical bottom portion, a cylindrical intermediate portion and a frusto-conical top portion having an opening rotatably mounted to the upper inner wall, the bottom portion and the intermediate portion of the rotating basin having a plurality of apertures formed therein for allowing fluidic communication with an interior of the fixed casing, the rotating basin further having a plurality of agitator strips each coupled along an inner surface of the rotating basin and extending from a center of the bottom portion of the rotating basin to a central extent of the intermediate portion, wherein the agitator strips each have a serpentine configuration;

a rotation motor mounted to the bottom face of the housing below the fixed casing with a rotor extending through the fixed casing and coupled to the rotating basin for rotating the same upon the actuation thereof;

a hot air generation assembly including a blower mounted on the bottom face of the housing adjacent the peripheral side wall with a vertically oriented delivery tube connected between the blower and an upper extent of the fixed casing for delivering hot air thereinto upon the actuation thereof;

an exhaust mechanism including an exhaust tube connected between a slot formed in the connector wall and a port mounted on the rear face of the housing, a filter unit including an inwardly tapering frusto-conical module mounted on an underside of the lid of the housing for being inserted within the opening of the top face of the housing when the lid is closed, the module having a lower face with a matrix of bores formed therein and a periphery with an opening formed therein for communicating with the slot of the connector wall of the housing when the lid is closed for allowing air to pass through a filter positioned within the module and out the exhaust port;

a water delivery assembly including an inlet conduit connected between the upper extent of the fixed casing opposite the delivery tube of the hot air assembly and the rear face of the housing for connection with a water source with a valve positioned therebetween for allowing the flow of water to the fixed casing upon the actuation thereof;

a water expelling mechanism including a pump mounted on the bottom face of the housing and connected to a lower end of the fixed casing and a water outlet port for pumping water from the fixed casing to the water outlet port upon the actuation thereof; and a control panel positioned on the top face of the housing along the rear face thereof, the control panel including a keypad and a display for selectively actuating the rotation motor, the blower of the hot air generation assembly, the valve of the water delivery assembly, and the pump of the water expelling mechanism.

2. A washer and dryer combination comprising:

a housing including a fixed casing;

a rotating basin rotatably mounted within the fixed casing;

a rotation motor for rotating the rotating basin upon the actuation thereof;

a hot air generation assembly for delivering hot air into the rotating basin upon the actuation thereof;

an exhaust mechanism for expelling air from the rotating basin;

a water delivery assembly for allowing the flow of water into the rotating basin upon the actuation thereof;

a water expelling mechanism including a pump for pumping water from the rotating basin upon the actuation thereof;

a control panel including a keypad and a display for selectively actuating the rotation motor, the hot air generation assembly, the water delivery assembly, and the pump of the water expelling mechanism; and wherein a lid is pivotally coupled to the housing for selectively covering an opening in the housing, the lid having a module mounted to an underside thereof including a bottom face with at least one aperture formed therein and a side face with at least one opening formed therein for communicating with an exhaust outlet of the housing when the lid is closed, wherein a filter is positioned within the module for filtering air passing therethrough.

3. A washer and dryer combination as set forth in claim 2 wherein the rotating basin is rotatable about an axis which forms an acute angle with a vertical.

4. A washer and dryer combination as set forth in claim 2 wherein the rotating basin has a plurality of agitators each mounted therein with a serpentine orientation.

5. A washer and dryer combination as set forth in claim 2 wherein the rotation motor is mounted on a bottom face of the housing with a rotor connected to the rotating basin through the fixed casing for rotating the same.

* * * * *